US005983416A

United States Patent [19]

Idland

[11] Patent Number: 5,983,416

[45] **Date of Patent: *Nov. 16, 1999**

[54] ELECTRICALLY POWDERED SPA JET UNIT

[75] Inventor: Carsten H. Idland, Los Angeles, Calif.

[73] Assignee: Softub, Inc., Chatsworth, Calif.

[ * ] Notice: This patent is subject to a terminal disclaimer.

[21] Appl. No.: 09/059,176

[22] Filed: Apr. 14, 1998

Related U.S. Application Data

[63] Continuation-in-part of application No. 08/755,306, Nov. 22, 1996, Pat. No. 5,742,954.

[51] Int. Cl.[6] ..... A61H 33/02

[52] U.S. Cl. ..... 4/541.1; 4/541.6; 4/492; 4/509

[58] Field of Search ..... 4/541.1–541.6, 4/492, 509

[56] References Cited

U.S. PATENT DOCUMENTS

| | | | |
|---|---|---|---|
| 817,314 | 4/1906 | Hahn . | |
| 1,347,082 | 7/1920 | Davis . | |
| 2,930,324 | 3/1960 | Toulmin, Jr. . | |
| 3,571,818 | 3/1971 | Jacuzzi . | |
| 3,886,936 | 6/1975 | Wehrenberg . | |
| 4,169,293 | 10/1979 | Weaver | 4/541.3 |
| 4,233,694 | 11/1980 | Janosko et al. | 4/541.3 |
| 4,282,866 | 8/1981 | Miffitt . | |
| 4,335,854 | 6/1982 | Reynoso | 4/541.6 |
| 4,537,565 | 8/1985 | Edler . | |
| 4,607,627 | 8/1986 | Leber et al. . | |
| 4,716,605 | 1/1988 | Shepherd et al. | 4/541.3 |
| 4,800,046 | 1/1989 | Malek et al. | 4/541.6 |
| 4,853,987 | 8/1989 | Jaworski . | |
| 4,867,656 | 9/1989 | Hirose . | |
| 4,907,305 | 3/1990 | Teramachi et al. . | |
| 4,928,885 | 5/1990 | Nakao | 4/541.6 |
| 4,941,217 | 7/1990 | Tobias et al. | 4/541.6 |
| 4,972,531 | 11/1990 | Gravatt . | |
| 5,011,379 | 4/1991 | Hashimoto . | |
| 5,056,168 | 10/1991 | Mersmann . | |
| 5,151,017 | 9/1992 | Sears et al. | 4/541.3 |
| 5,173,973 | 12/1992 | Mersmann | 4/541.1 |
| 5,386,598 | 2/1995 | Mersmann . | |
| 5,428,849 | 7/1995 | Watkin et al. . | |
| 5,454,195 | 10/1995 | Hallsten . | |
| 5,507,058 | 4/1996 | Minami et al. | 15/1.7 |
| 5,509,792 | 4/1996 | Sullivan et al. . | |
| 5,548,852 | 8/1996 | Rowe . | |

FOREIGN PATENT DOCUMENTS

| | | | |
|---|---|---|---|
| 132871 | 4/1933 | Austria . | |
| 312885 | 4/1989 | European Pat. Off. . | |
| 590580 | 4/1994 | European Pat. Off. | 4/541.1 |
| 1227969 | 4/1960 | France . | |
| 2087513 | 12/1971 | France . | |
| 3703273 | 8/1988 | Germany | 4/541.1 |
| 4032448 | 1/1992 | Germany . | |
| 6142156 | 5/1994 | Japan . | |

*Primary Examiner*—Charles R. Eloshway
*Attorney, Agent, or Firm*—William W. Haefliger

[57] ABSTRACT

A spa water delivery system, the spa includes a wall structure exposed to a water reception zone, and combination comprising: a water delivery structure associated with the wall structure to deliver water to the zone; a manually operable signaling device carried by the wall structure to be operated by a bather in the water reception zone; a sensor spaced from the signaling device to be out of contact with spa water, and responsive to operation of the signaling device to produce a control signal; whereby the control signal may be used to control a flow characteristic of water flowing via the delivery structure to the zone.

12 Claims, 16 Drawing Sheets

JET FLOW OUT OF A HOLE ~312~

SUCTION FLOW INTO A HOLE ~312~

JET FLOW WITH DIFFUSER

SUCTION FLOW WITH DIFFUSER

ELECTRICALLY POWDERED SPA JET UNIT

This application is a continuation-in-part of U.S. application Ser. No. 08/755,306 filed Nov. 22, 1996, now U.S. Pat. No. 5,742,954, incorporated herein by reference.

BACKGROUND OF THE INVENTION

This invention relates generally to improvements in structure and operation of hydrotherapy massage jets of the type used in spas and hot tubs, and the like. More specifically, it relates to the control of pumping of fluid via such jets to the spa or tub interior, and also to regulation of fluid flow to and from a self-contained jet fluid pumping unit.

Spa jets for use in spas, swimming pools, and hot tubs, and the like, are generally known in the art to provide a hydrotherapy massage action. In particular, conventional spa jets are mounted in the wall of a spa or hot tub and coupled by plumbing lines to a water recirculation system, including a pump which draws water from the pool or spa and recirculates that water to and through one or more spa jets for return flow to the pool or spa. The spa jets are designed to produce a pressure jet flow of water, which is discharged into the body of water within the pool or spa, often by means of a directionally adjustable discharge nozzle. A person within the pool or spa can orient himself in a selected position relative to a spa jet to receive a vigorous and desirably therapeutic massage action.

While conventional spa jets of the above-described type are widely used and provide a desirable hydrotherapeutic benefit, a relatively complex plumbing network is required for water recirculation to the spa jet. This plumbing network is normally installed at the time of spa construction by positioning the necessary flow conduits directly within the structural wall of the spa. This arrangement is relatively complicated and expensive, and thus contributes significantly to the overall cost of a spa system. In addition, a person using the spa typically has little or no control, other than directional adjustment over the power of the water jet discharged into the spa.

There is need for improved spa jet unit which can be mounted quickly and easily into a spa wall without requiring construction of complex plumbing flow conduits; and further, wherein the improved spa jet is adapted for relatively simple and adjustable regulation of the power and flow characteristics of a discharge water jet.

There is also need for simple, effective control of a jet-pumping unit, and for effective regulation of fluid flow to and from a self-contained fluid jet-pumping unit.

SUMMARY OF THE INVENTION

It is a major object of the invention to provide a solution to the problems and difficulties with prior water jetting systems, as used in spas and hot tubs. Basically, the invention concerns provision in a spa unit having wall means facing toward or bounding a water reception zone, of:

a) one or more water pumps associated with the wall means, the pumps spaced about the zone, and the pump or pumps oriented to receive water intake from the zone and to discharge water streams into the zone, b) each pump including water pumping structure, and there being means for controlling pumping operation of such structure, as by a bather in the spa interior.

As will be seen, the water-pumping structures may be independently operable and are spaced about the zone.

Another object is to provide:

a) water delivery structure associated with the wall means to deliver water to the zone, b) a manually operable signaling device carried by the wall means to be operated by a bather in the water reception zone, c) a sensor spaced from the signaling device to be out of contact with spa water, and responsive to operation of the signaling device to produce a control signal, d) whereby the control signal may be used to control a flow characteristic of water flowing via the delivery structure to the zone.

Such apparatus provides a means to transmit an input signal to an electronic spa or jetted bath control system in a safe, convenient and low cost manner. The apparatus allows for a signal (magnetic field) to be transmitted through a surface (the housing) to a sensor (Hall Effect or reed switch), which controls the pumping means. The end result is the bather is able to move an element within the spa or jetted bath, which is attached to the water side of the jet housing, and create an electrical output signal by a device on the dry side of the housing, thereby safely eliminating wet bather contact with any electrical elements.

A further object is to provide a signaling which produces a magnetic field, the sensor located in that field to be responsive to a changing characteristic of the field.

In one embodiment, the invention comprises a rotating ring, a magnet and a linear Hall Effect sensor all located in a hydrotherapy jet housing. The Hall Effect sensor responds to varying magnetic fields by producing a varying voltage output. An example of such a sensor is the Model 3503 sensor made by Allegro Microsystems Inc. of Worcester, Mass.

In this embodiment, the Hall Effect sensor is mounted in the wall of the jet housing. A rotating ring with an embedded magnet is typically mounted inside the jet housing, so that it is able to rotate freely. The effect of rotating the ring is to vary the distance of the magnet to the sensor, thereby varying the voltage output signal of the sensor. This signal can then be used as a means to signal the electronic controls to vary the pulse rate of the pumping unit, as well as to turn it completely off.

In another embodiment, the linear Hall Effect sensor can be replaced with a Hall Effect switch. An example of this would be the Model 3133 from Allegro Microsystems Inc. In this embodiment, the control would be able to act as an on/off signal to the electronic control system.

In yet another embodiment, the Hall Effect sensor is replaced with a reed switch. The reed switch in its most common form is a device that produces a switch closure when in the presence of a magnetic field. An example of such a device would be the Model MDSR-7 made by Hamlin Inc. of Lake Mills, Wis.

An additional object is to provide water delivery structure, which includes i) porting associated with the wall means and via which water is delivered to the zone, ii) water pumping structure controlled by the sensor to deliver water to the porting.

As will appear, the water delivery structure typically includes at least one pump structure oriented to receive water intake from the zone and to direct water into the zone, the pumping structure controlled by the control signal. The pumping structure typically includes a chamber having a water inlet and outlet, and a water displacing reciprocating element operable to draw water into the chamber via the inlet and to discharge water to flow from the chamber through the outlet to the spa interior zone, water also flowing to the side of the element opposite the chamber.

Yet another object is to provide a diffuser in alignment with the water delivery structure, and adjustable to control a characteristic of the water flow.

These and other objects and advantages of the invention, as well as the details of an illustrative embodiment, will be more fully understood from the following specification and drawings, in which:

DRAWING DESCRIPTION

DETAILED DESCRIPTION

Figure 12:
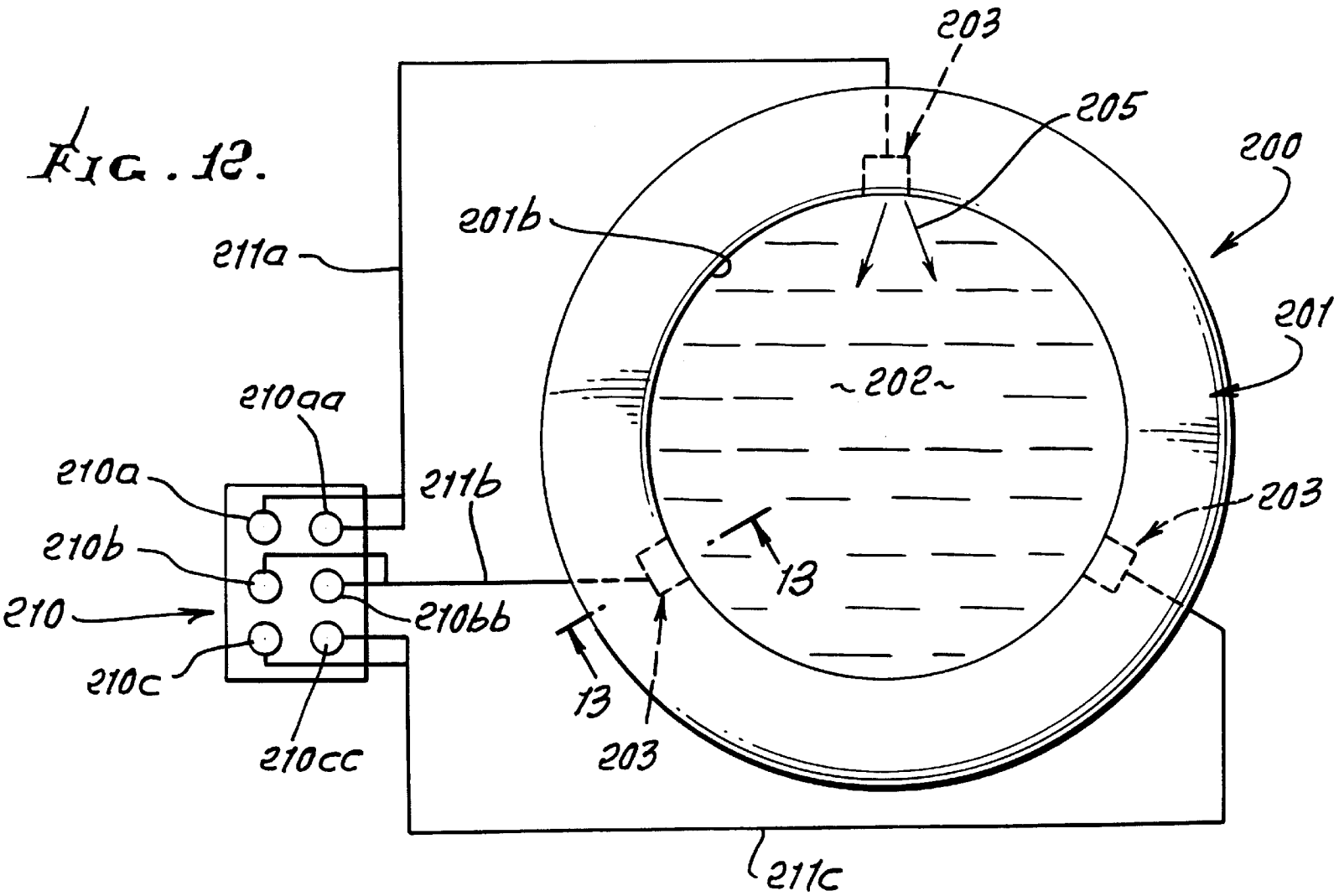
FIG. 12 is a plan view of a spa having multiple pumps.
Figure 13:
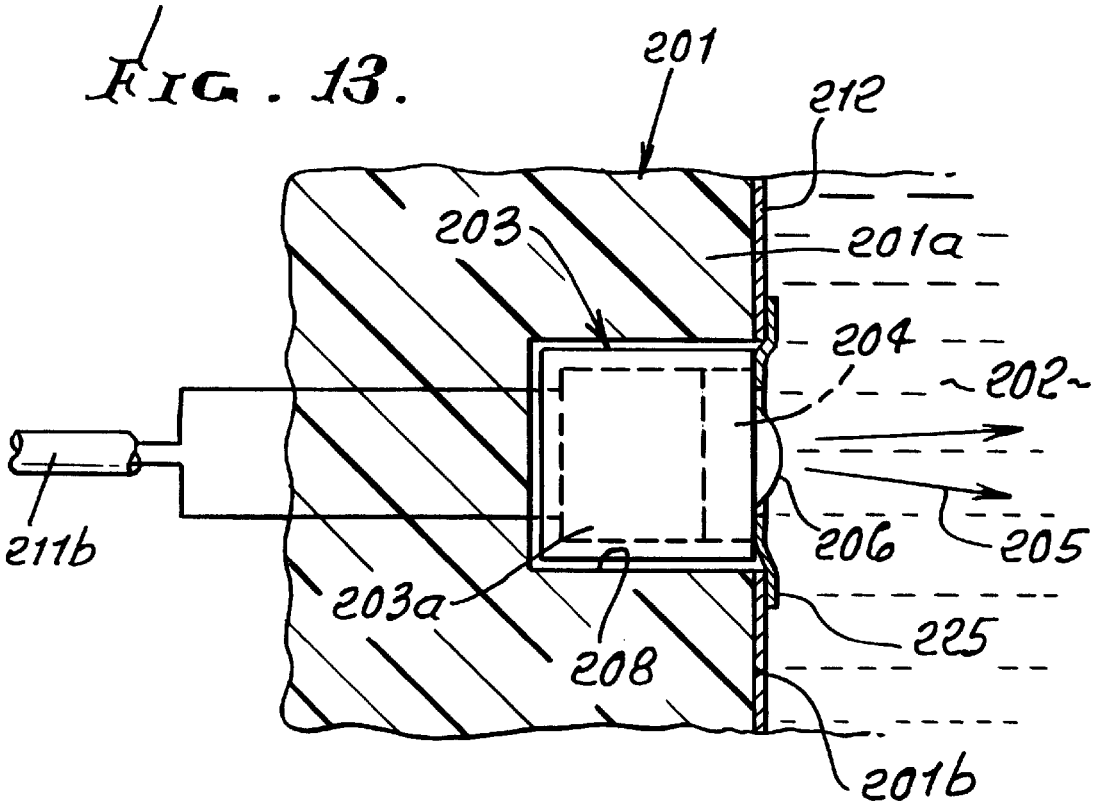
FIG. 13 is an enlarged view on lines 13—13 of FIG. 12.

Referring first to FIGS. 12 and 13, a spa 200, includes wall means, as at 201, facing toward a water reception zone 202. The wall means may include a synthetic resinous wall 201*a* bounding zone 202. The inner face of the wall means appears at 201*b*.

A plurality of water pumps are associated with the wall means, the pumps indicated generally at 203, and as spaced about zone 202. If desired, only one pump may be employed, and any number of pumps may be used. The pump or pumps are oriented to individually receive water intake from zone 202 at intake port or ports 204, and to discharge water streams 205 into zone 202, as via discharge ports. Such ports are defined by nozzle or nozzles 206.

Water pumping structure is indicated by block 207, in the pump 203 seen in FIG. 13. Note pump housing 203*a* received in the recess 208, formed in the wall 201*a*. It may be retained in position frictionally, or by other means. The water pumps are preferably independently operable, as by drive means associated with each pump and located at the pump. Also, the pumps may be operated to vary the rate of pumping action, and the stroke of the pumping element, i.e., variable as to amplitude and frequency of pumping action, to vary the jets 205 to best use of the bather. In this regard, while the pumps are herein described as operating by reciprocation, it is possible to provide rotary impeller-type pumps having controllably variable impeller rates of rotation, and so long as the jets 205 are directed toward the interior region of the spa, as indicated.

Control means to control the pumping structure is indicated generally at 210 in FIG. 12. Note the three cables 211*a*, 211*b*, and 211*c* extending respectively to the drivers at the three pumping structures 203 shown for independent control. Note the frequency and amplitude controls 210*a* and 210*aa* controlling one pump via cable 211*a*; frequency and amplitude controls 210*b* and 210*bb* controlling a second pump via cable 211*b*; and frequency and amplitude controls 210*c* and 210*cc* controlling a third pump via cable 211*c*. ON-OFF switches may be provided in or proximate of the controls 210*a*, 210*aa*, 210*b*, 210*bb*, 210*c*, and 210*cc*, for further selective control, in various combinations of amplitude and frequency of pumping action at different pumps. A spa liner may be employed, as at 212, and clamped by a pump flange 225.

As a result, a minimum of pumping structure is provided; no water liner or ducts in wall 201 are needed; the pumps are individually and independently operable and controllable.

Figure 1:
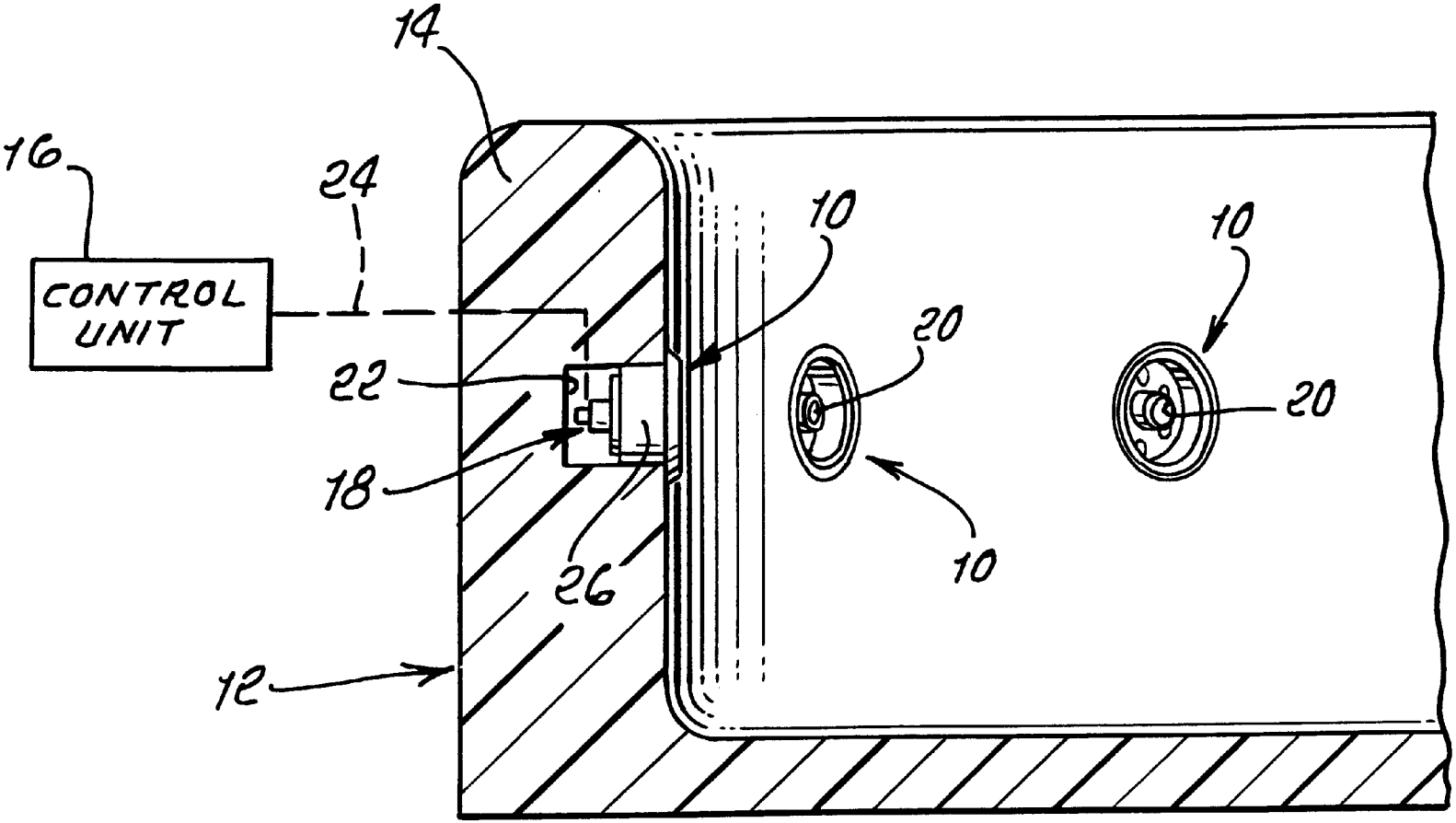
FIG. 1 is a fragmented vertical sectional view illustrating a spa, including a plurality of electrically powered spa jet units embodying the novel features of the invention.
Figure 2:
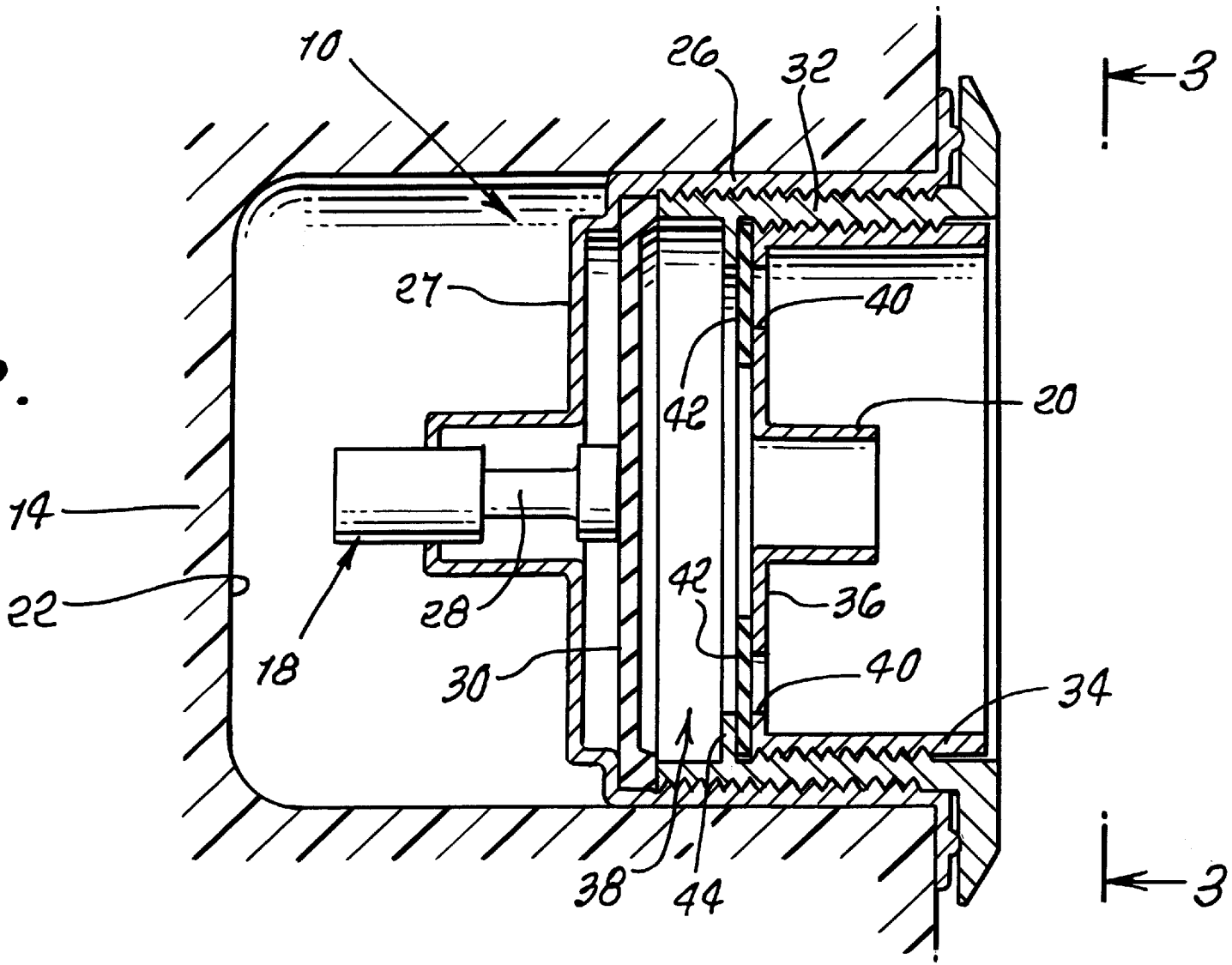
FIG. 2 is an enlarged fragmented vertical sectional view showing one of the spa jet units of FIG. 1, mounted into the spa wall.
Figure 3:
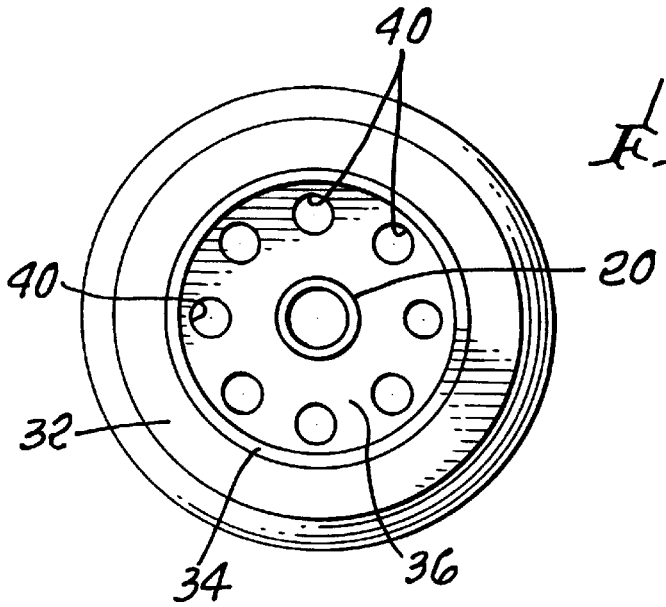
FIG. 3 is a front end elevational view of the spa jet unit, taken generally on lines 3—3 of FIG. 2.

In the exemplary drawings 1–11, an electrically powered spa jet unit, referred to generally in FIG. 1 by the reference numeral 10, is provided for use in a spa 12 or the like, to deliver a discharge jet of water to provide a hydrotherapy massage action. The spa jet unit 10 is typically installed in a side wall 14 of the spa in several selected locations about the spa perimeter and below the normal water fill line. Each jet unit 10 represents a relatively compact and substantially self-contained unit, which can be individually controlled by an appropriate control unit 16, all without requiring complex plumbing flow conduit networks and related recirculation pump devices.

In general terms, the spa jet unit 10 of the present invention includes an electrically powered reciprocal element 18 adapted for regulation by the control unit 16 to deliver a pulsating jet of water through a discharge nozzle 20. Each jet unit 10 is adapted for mounting into an open-sided pocket 22 formed in the side wall 14 of the spa 12, with appropriate electrical conductors 24 interconnecting each jet unit 10 to the control unit 16. No plumbing conduits or related recirculating equipment is required. As a result, the overall hydrotherapy massage system is relatively simple and economical.

The spa jet unit 10 is shown in one preferred form in more detail in FIGS. 2–5. As shown, the jet unit 20 comprises a generally cup-shaped outer housing 26 adapted for slide-fit reception into the side wall pocket 22, with the reciprocal element 18 comprising a solenoid mounted on a base wall 27 of the housing 26. The solenoid 18 includes a reciprocal plunger 28 having a free end contacting and preferably connected to a central region of a resilient diaphragm 30 formed from a suitable elastomeric material. An outer rim of the diaphragm 30 is trapped or retained against the periphery of the housing base wall 27 by a retainer sleeve 32 mounted within the outer housing 26, as by means of a threaded interconnection therebetween.

A port sleeve 34 is mounted in turn within the retainer sleeve 32, as by a further threaded connection therebetween. The port sleeve 34 defines a port wall 36, which extends across the interior of the spa jet unit in a position spaced forwardly from a normal, unstressed position of the diaphragm 30. Thus, the port sleeve 34 cooperates with the diaphragm 30 to define a pump chamber 38 for the spa jet unit.

A plurality of intake ports 40 are formed in the port wall 36 in a circular pattern about the centrally positioned discharge nozzle 20, which is also formed in the port wall 36. Importantly, the rear or inboard sides of the intake ports 40 are normally covered by resilient valve flaps 42, which are retained between an inboard end of the port sleeve 34 and a short flange 44 formed on the retainer sleeve 32.

Figure 4:
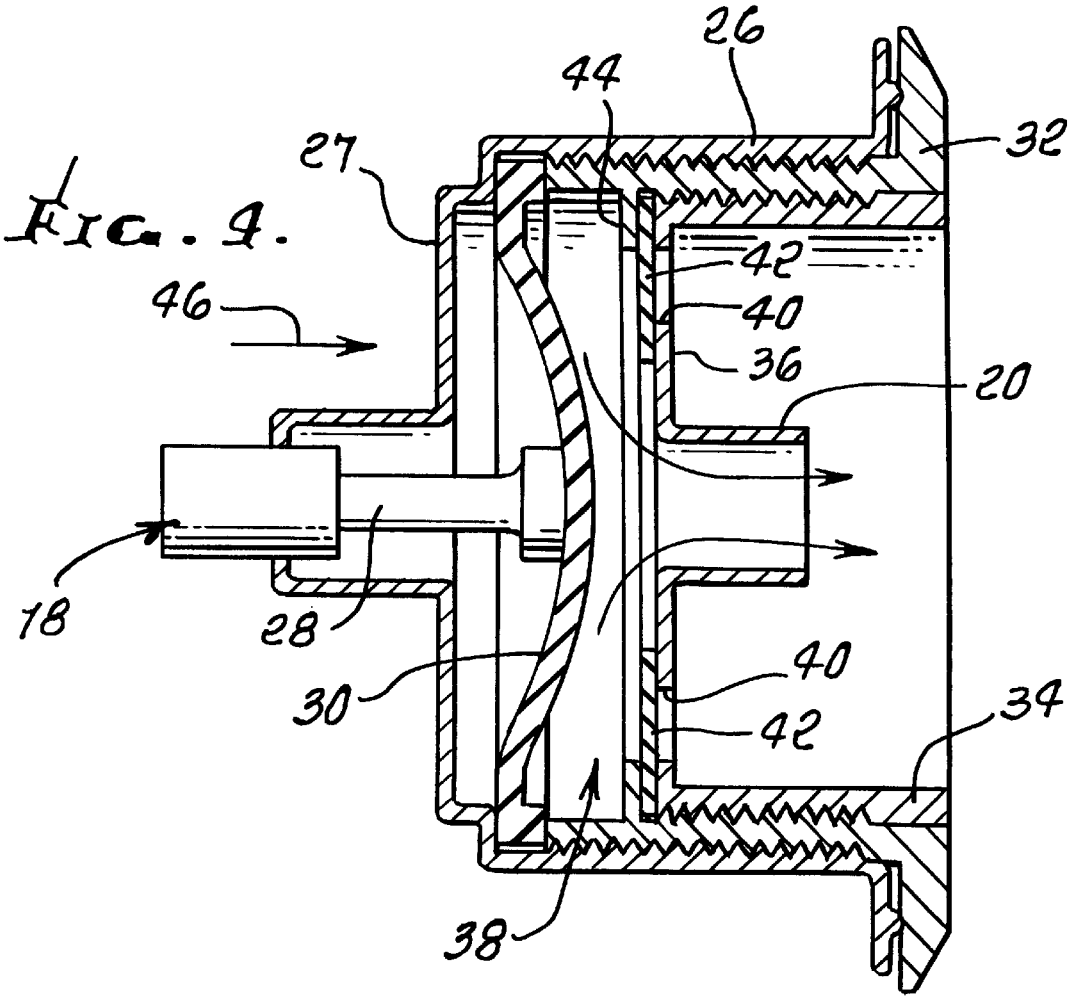
FIG. 4 is a fragmented vertical sectional view similar to FIG. 3 and illustrating operation of the spa jet unit to deliver a discharge jet of water to the spa.
Figure 5:
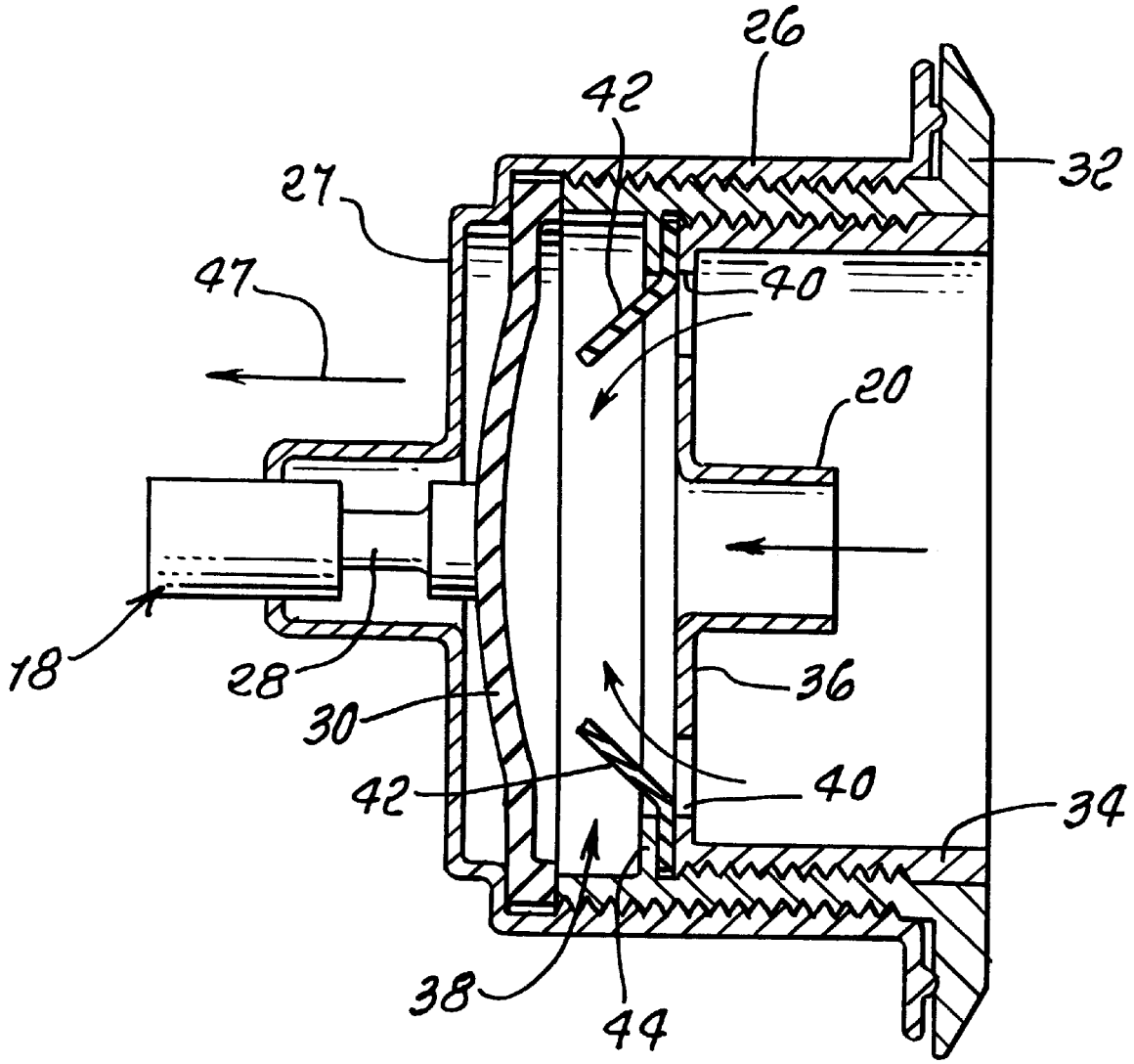
FIG. 5 is a fragmented vertical sectional view similar to FIG. 4 and depicting operation of the spa jet unit to draw water in from the spa.

As shown in FIGS. 4 and 5, reciprocal operation of the solenoid 18 is effective to draw water from the spa into the pump chamber 38 (FIG. 5), and then to discharge that water as the pressure discharge jet through the nozzle 20 (FIG. 4). More particularly, as shown in FIG. 4, movement of the solenoid plunger 28 through an advance stroke depicted by arrow 46 expels water from the pump chamber 38 in the form of a discharge jet passing outwardly through the nozzle 20. During this stroke movement, the water pressure within the chamber 38 effectively retains the valve flaps 42 in a closed position, thereby confining water discharge to passage through the nozzle 20. Subsequent movement of the plunger 28 through a retraction stroke, as depicted by arrow 47 in FIG. 5, causes the diaphragm 30 to flex rearwardly, resulting in a momentary vacuum within the chamber 38, whereby water is drawn from the spa into the pump chamber 38 through the intake ports 40, as well as via the nozzle 20. FIG. 5 shows pressure-caused retraction of the valve flaps 42 to accommodate relatively free inflow of water through intake ports 40 into the pump chamber 38.

The control unit 16 (FIG. 1) includes appropriate controller components for regulating the operation of the solenoid 18 in a manner achieving adjustable discharge jet power and pulse rate. For example, a pulse width modulator with frequency control may be used for regulating the reciprocating frequency and/or stroke length of the solenoid 18, according to the preferences of an individual using the spa. Alternately, pulse width modulation systems may be employed to achieve a range of power and frequency selection, which can be programmed through variable speed frequencies. The control unit 16 may be used for common control of multiple spa jet units 10, or otherwise adapted to individually control each spa jet unit.

Figure 6:
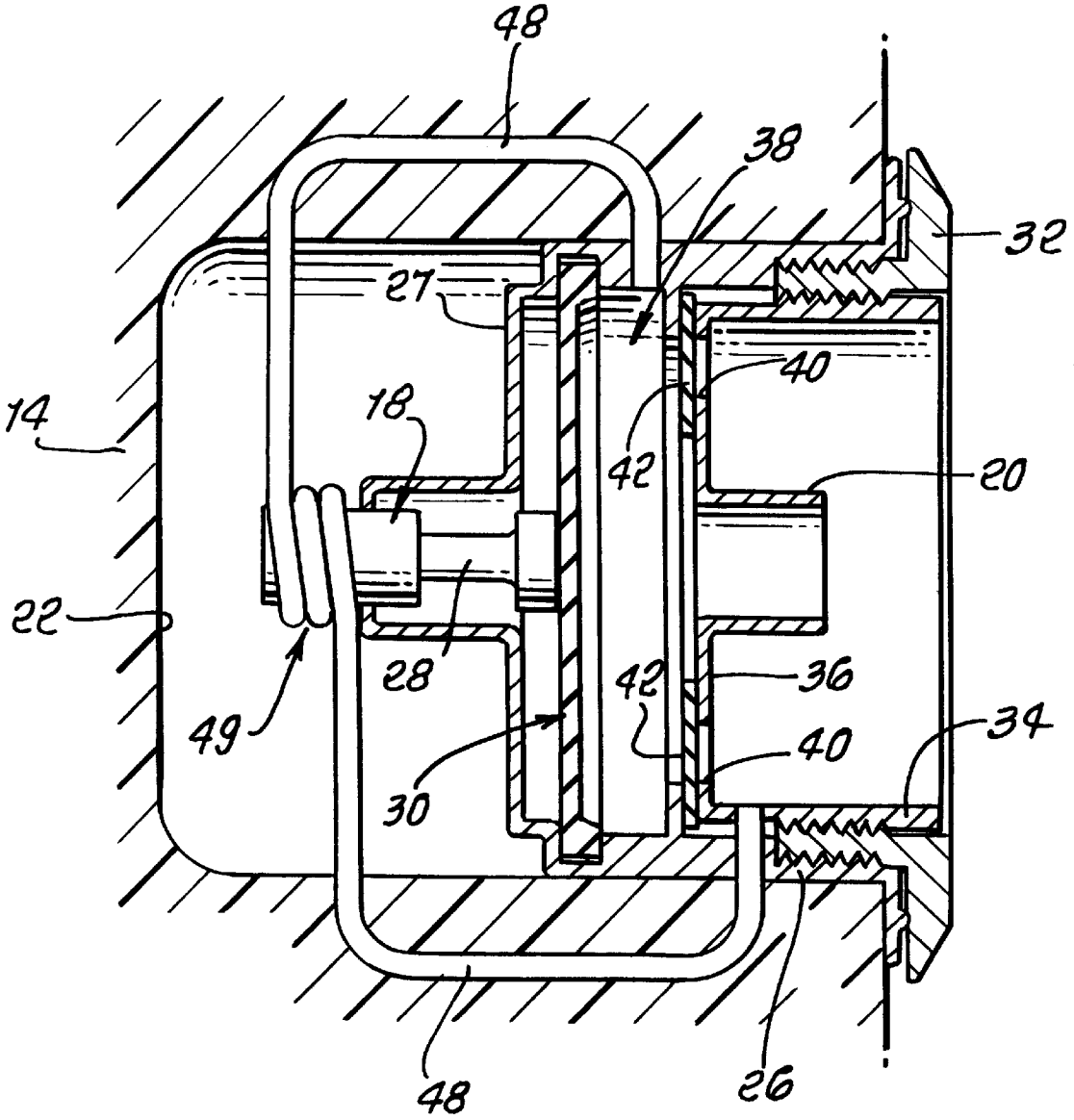
FIG. 6 is a fragmented vertical sectional view similar to FIG. 2, and illustrating an alternative form of the invention, which uses the spa water for solenoid cooling.

FIG. 6 illustrates one alternative form of the invention wherein components identical to those shown and described in FIGS. 1–5 are referred to by common reference numerals. FIG. 6 differs from the embodiment of FIGS. 1–5 in that a small flow of water is employed to cool the solenoid 18, thereby preventing overheating thereof during operation. As shown, this small water flow is obtained by providing a small circulation tube 48 with an inlet end tapped into the pump chamber 38. The circulation tubing 48 includes a coil segment 49 wrapped about the winding portion of the solenoid 18 in heat transfer relation therewith, and then extends to a discharge end connected to the region in front of the port wall 36. During reciprocal solenoid operation, a small portion of the water under pressure within the pump chamber 38 is forced to flow through the circulation conduit 48 to cool the solenoid.

Figure 7:
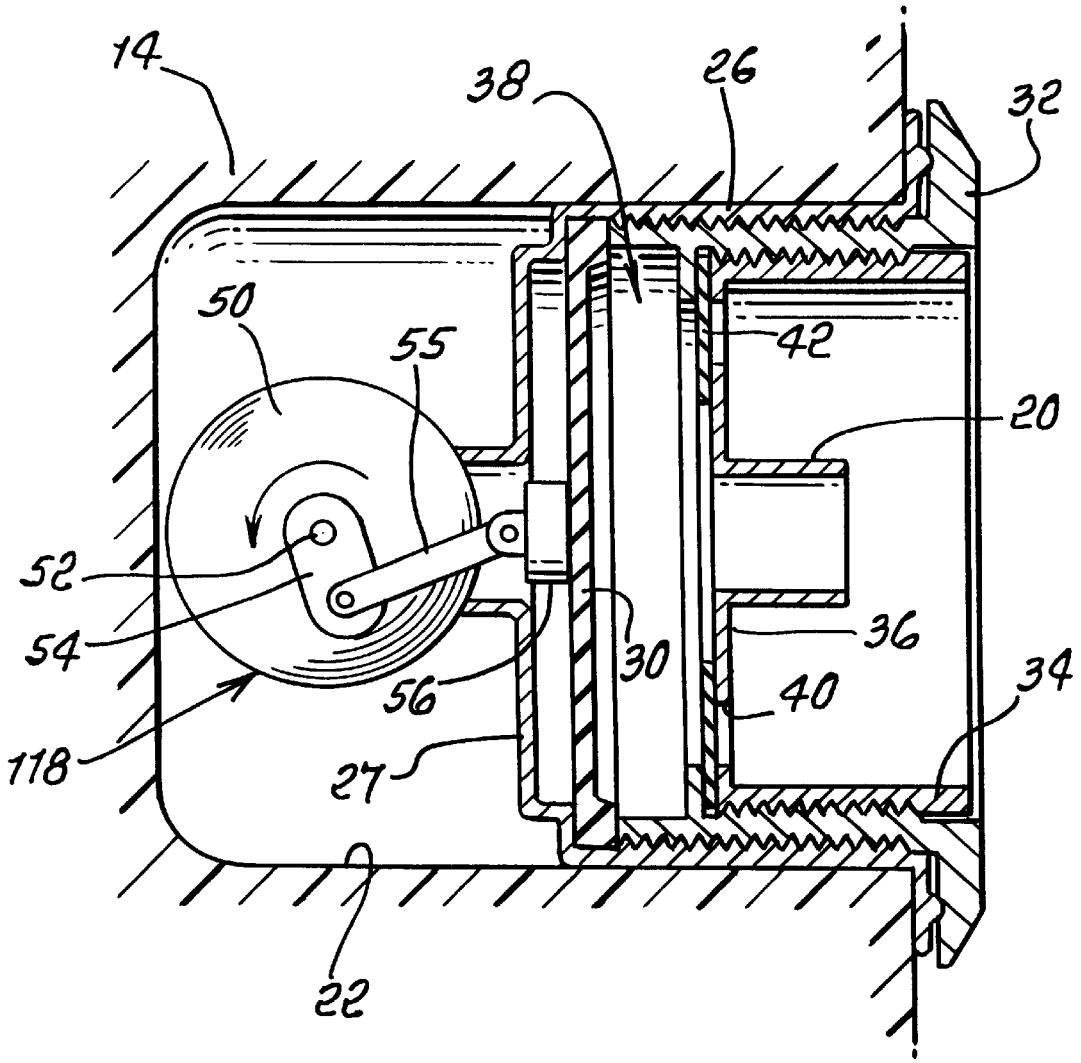
FIG. 7 is a fragmented vertical sectional view similar to FIG. 2 but illustrating an alternative electrically-driven reciprocal element.

FIG. 7 shows another alternative form of the invention wherein a modified reciprocal element 118 is provided in lieu of the solenoid device shown in FIGS. 1–6. In this version, an electric motor 50 is mounted on the base wall 27 of the outer housing 26, and includes a rotary output shaft 52 connected by a pair of crank links 54 and 55 to a head 56 coupled to the diaphragm 30, in the same manner as previously described with respect to the is solenoid plunger 28. Operation of the motor 50 displaces the crank links 55 and 55 in a manner providing the desirable reciprocal action of the diaphragm 30, as previously described.

Figure 8:
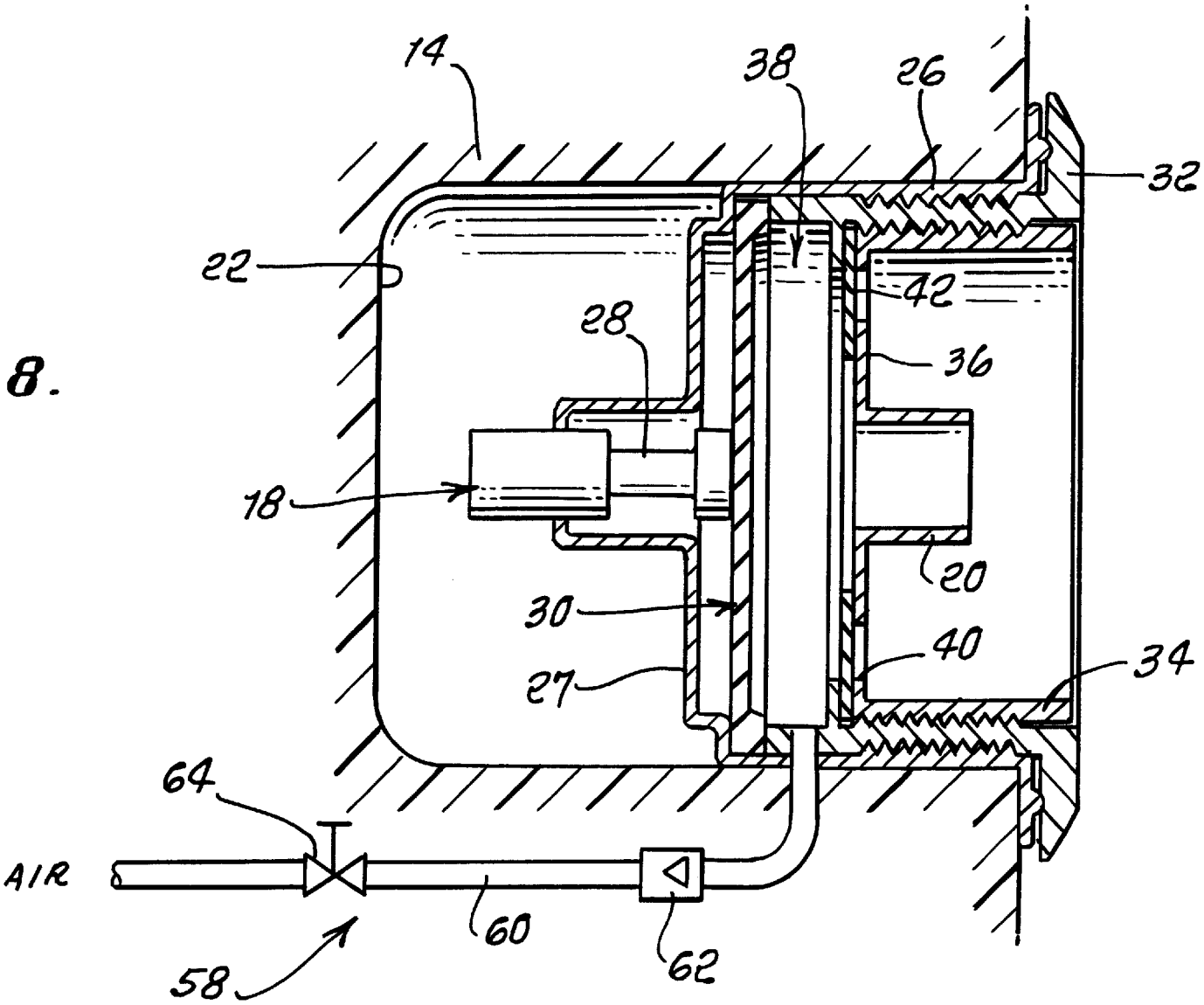
FIG. 8 is a fragmented vertical sectional view similar to FIG. 2 and illustrating air induction tubing for use in combination with the spa jet unit.

FIG. 8 shows a further alternative form of the invention, generally in accordance with FIGS. 1–5, except for the inclusion of an air induction system 58. The structural components shown in FIG. 8 are otherwise identical to those shown and described in FIGS. 1–5, and are thus identified by common reference numerals. The air induction system 58 comprises an air induction tube 60 having one end coupled to ambient air, and an opposite end tapped into the pump chamber 38. A one way check valve 62 is mounted along the air tube 60 to permit air inflow to the pump chamber 38, while preventing water backflow through the air tube. A control valve 64 may be provided to regulate air flow through the air tube 60.

During operation, and upon retraction motion of the diaphragm 30 to draw water into the pump chamber 38, the momentary vacuum in the pump chamber 38 additionally draws air therein via the air tube 60. As a result, a quantity of air is entrained with the water within the pump chamber 38, for discharge with the water as an air-water jet during subsequent advance stroke motion of the diaphragm 30. The combined air-water jet is known to provide an enhanced therapeutic massage action.

Figure 9:
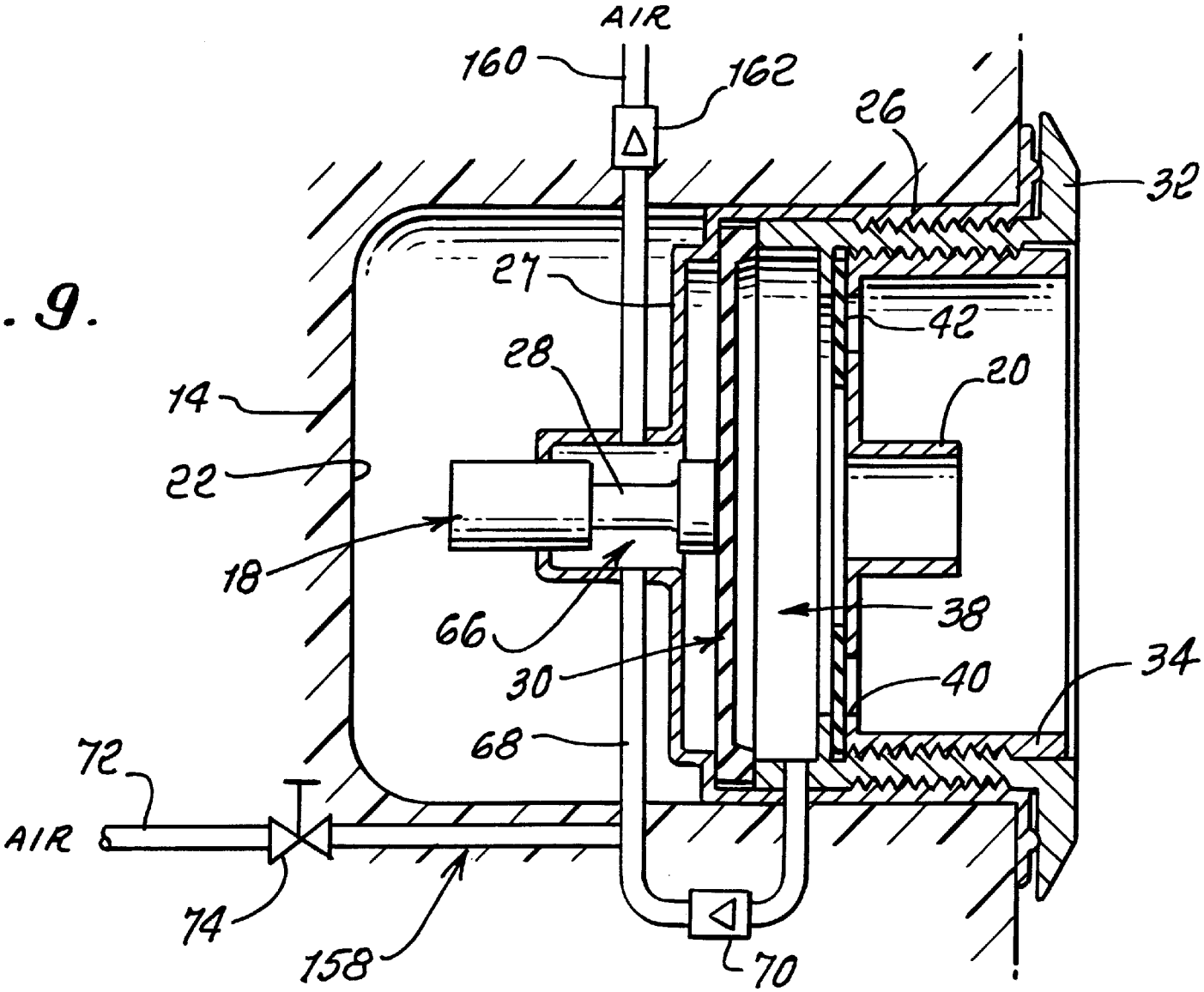
FIG. 9 is a fragmented vertical sectional view similar to FIG. 8, but illustrating an alternative air induction system for use with the spa jet unit.

FIG. 9 illustrates an alternative air induction system 158 wherein the back or inboard side of the diaphragm 30 cooperates with the housing base wall 27 to define an air chamber 66 for pumping air into the spa jet unit. In this version, an air tube 160 with a check valve 162 therein is provided for drawing air into the air chamber 66 each time the diaphragm 30 is displaced forwardly by the solenoid 18. Subsequent retraction of the diaphragm 30 is effective to expel air from the chamber 66 through a tube segment 68 and associated check valve 70 for passage into the pump chamber 38 and entrainment with water therein. A bleed tube 72 may be connected into the tube segment 68, and equipped with an adjustable valve 74 for regulating the amount of air injected into the pump chamber 38. Air injected into the pump chamber is, of course, expelled with the water as a combined air-water jet through the forward nozzle 20.

Figure 10:
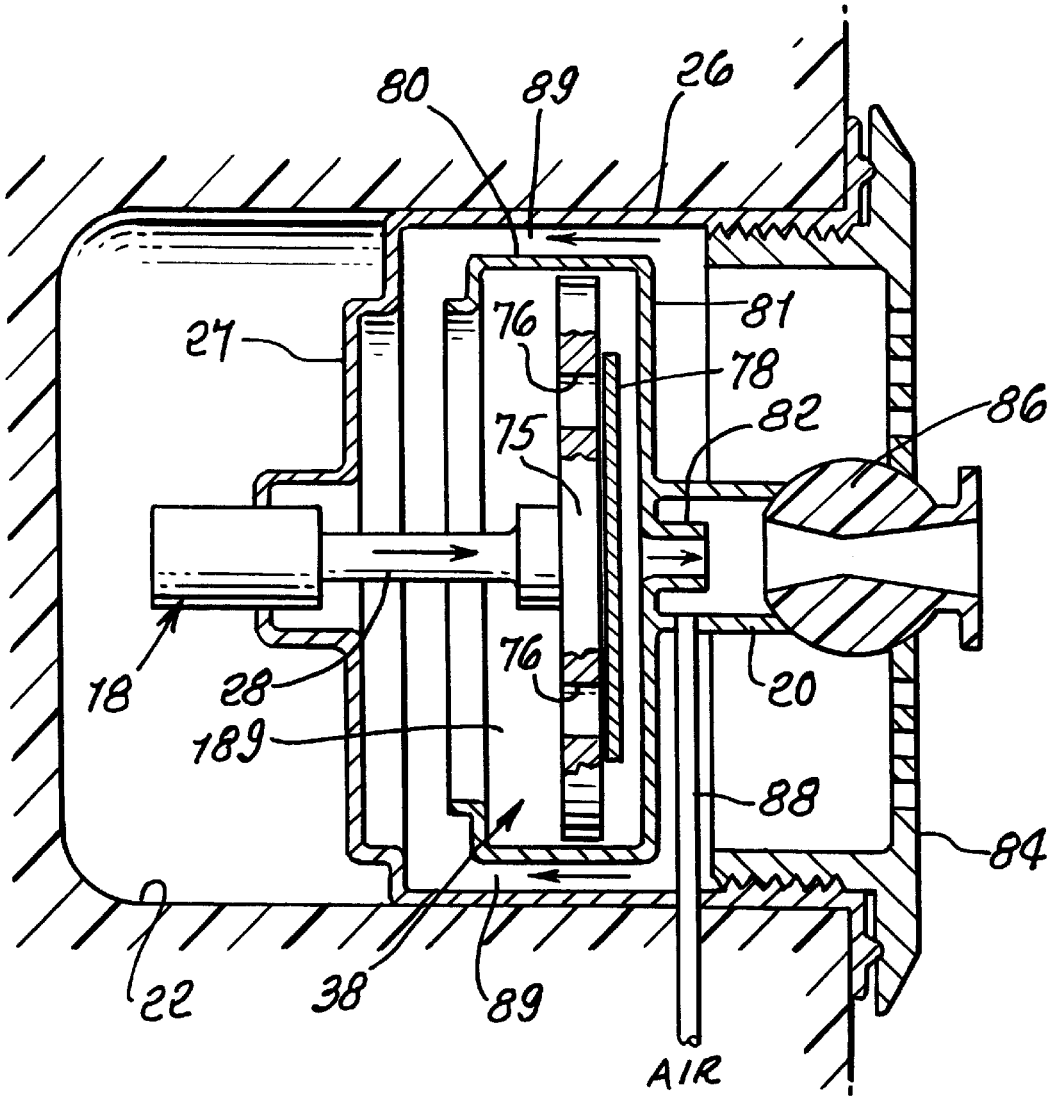
FIG. 10 is a fragmented vertical sectional view similar to FIG. 2, but depicting a further alternative form of the invention.
Figure 11:
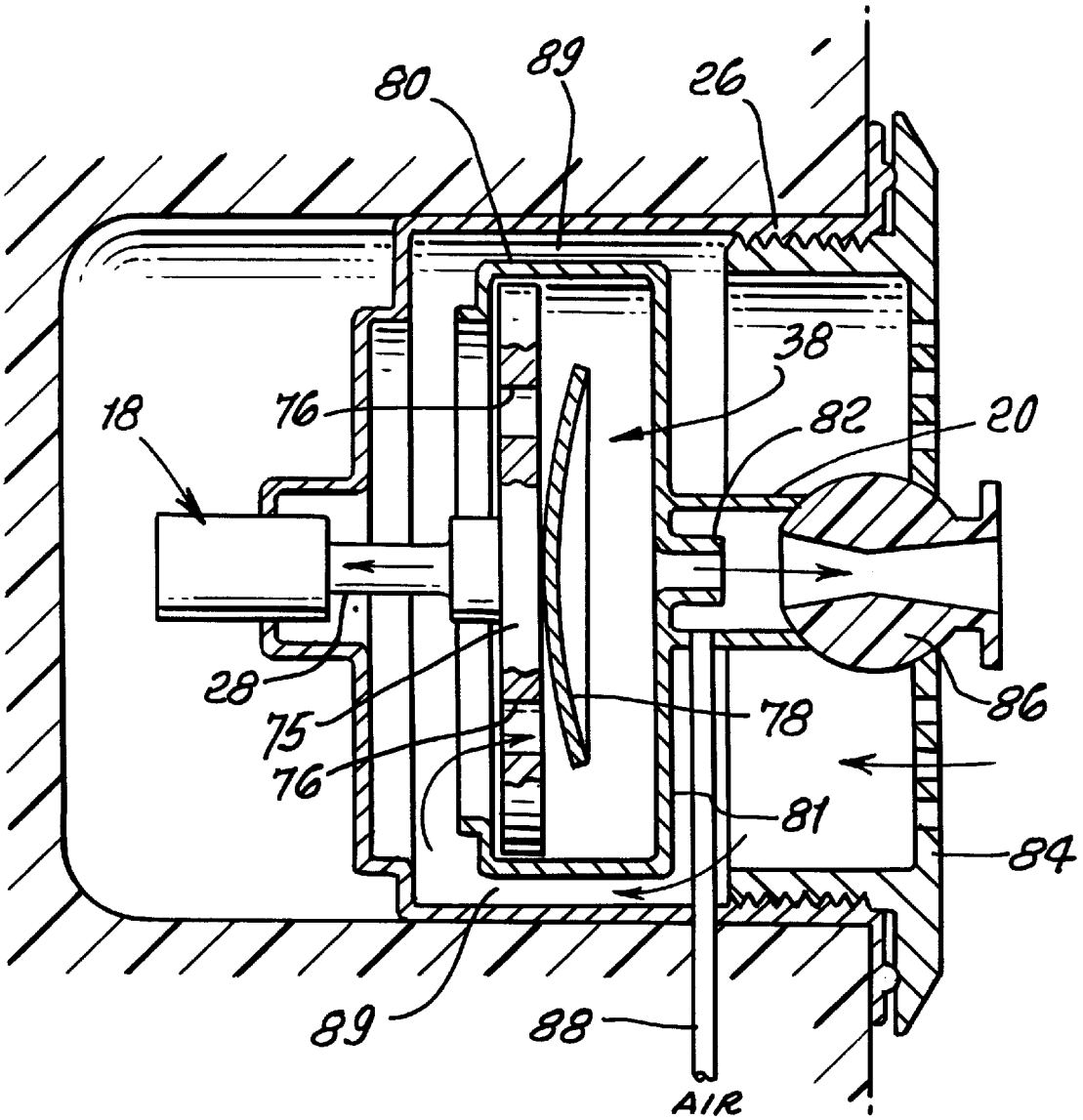
FIG. 11 is a fragmented vertical sectional view similar to FIG. 10, and showing the spa jet unit moved through a retraction stroke.

FIGS. 10 and 11 show still another alternative embodiment of the invention wherein components corresponding in structure and function to those shown and described in FIGS. 1–5 are identified by common reference numerals. In this embodiment, a cup-shaped outer housing 26 has a solenoid 18 carried by a base wall 27 thereof, with a reciprocal plunger 28 coupled to a pumping piston 75. The piston 75 comprises a circular plate having an annular array of pump ports 76 formed therein, with the outboard side of the ports 76 being normally covered by a resilient flap valve 78, the center of which is secured in a suitable manner to the pump piston 75. The piston 75 is reciprocally carried within a cylinder 80 and cooperates with a front wall 81 of the cylinder 80 to define the pump chamber 38. The pump chamber is open to the body of water within the spa through a forward discharge nozzle 20, which may include a narrow central jet port 82.

As shown, the outboard side of the spa jet unit includes a perforated cover plate 84, which cooperates with the nozzle 20 to retain an angularly adjustable nozzle fitting 86. An air induction tube 88 is coupled to the interior of the nozzle 20, at the downstream side of the jet 82, to permit entrainment of air therein in response to water pumping through the nozzle 20.

Advancement of the solenoid plunger 28 displaces the pump piston 75 in a forward direction within the pump chamber 38, to displace water therein as a discharge jet outwardly through the nozzle 20 and associated nozzle fitting 86. During this discharge step, the flap valve 78 sealingly overlies the piston ports 76, so that the water in the pump chamber 38 is forced outwardly into the spa (FIG. 10). While a peripheral seal may be provided between the pump piston 75 and the inner diameter of the cylinder 80, a small clearance between these elements will normally suffice to provide the desired pumping function.

Subsequent retraction of the solenoid plunger 28 draws the piston 75 rearwardly within the cylinder 80. In this regard, the inboard side of the pump piston 75 and the cylinder 80 is in open flow communication with the perforated coverplate 84, around the periphery of the cylinder 80, so that water behind the piston 75 is allowed to displace forwardly through the pump ports 76 into the pump chamber 38. The flap valve 78 flexes forwardly (FIG. 11) as the piston is drawn rearwardly by the plunger 28, to allow the water to flow through the pump piston 75. Accordingly, reciprocal driving of the piston 75 within the cylinder 80 affectively discharges a water jet through the nozzle 20 and nozzle fitting 86, in a pulsating fashion, to provide a desirable therapeutic massage action.

FIG. 10 also shows the pump unit in discharge motion, the flow channels 89 having water flowing in an inwardly direction, as marked by the arrows and toward chamber 189 rearwardly of the reciprocating elements 75 and 78. This flow is in opposite direction to the flow through the central jet port 82, as marked by the arrow and is a result of a negative pressure created rearwardly of element 75 as the element moves forwardly in the discharge motion. With proper design, these flows are balanced to cancel or reduce momentum forces transmitted to the spa or tub wall.

Referring to FIG. 11, it shows the pump unit in retraction motion. Flap seal 78 opens to allow free fluid movement through the reciprocating element. No substantial fluid movement is produced through central jet port 82 or through flow channels 89.

Figure 14:
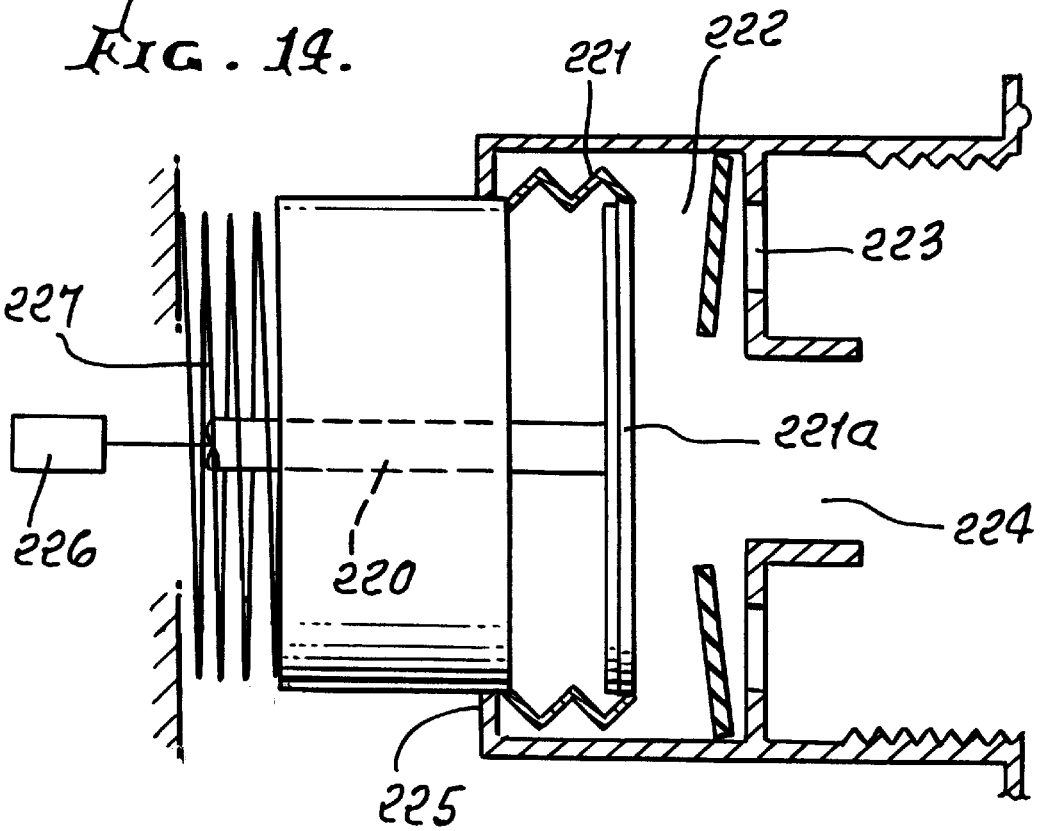
FIG. 14 shows a modification using a bellows.

FIG. 14 shows an embodiment wherein the reciprocating element 220 drives end wall 221*a* of a bellows 221 in reciprocation, to draw fluid into chamber 222 via ports 223 and passage 224, and to discharge fluid through passage 224. The bellows also provides a seal connection to chamber wall 225, to seal off and protect the solenoid 226 from the water. A return spring is used at 227.

In devices as described, the housing may consist of a material which readily transmits heat causing a thermal connection between the solenoid and water in order to cool the solenoid.

A variety of further modifications and improvements to the spa jet unit of the present invention will be apparent to persons skilled in the art. Accordingly, no limitation on the invention is intended by way of the foregoing description and accompanying drawings, except as set forth in the appended claims.

Figure 15:
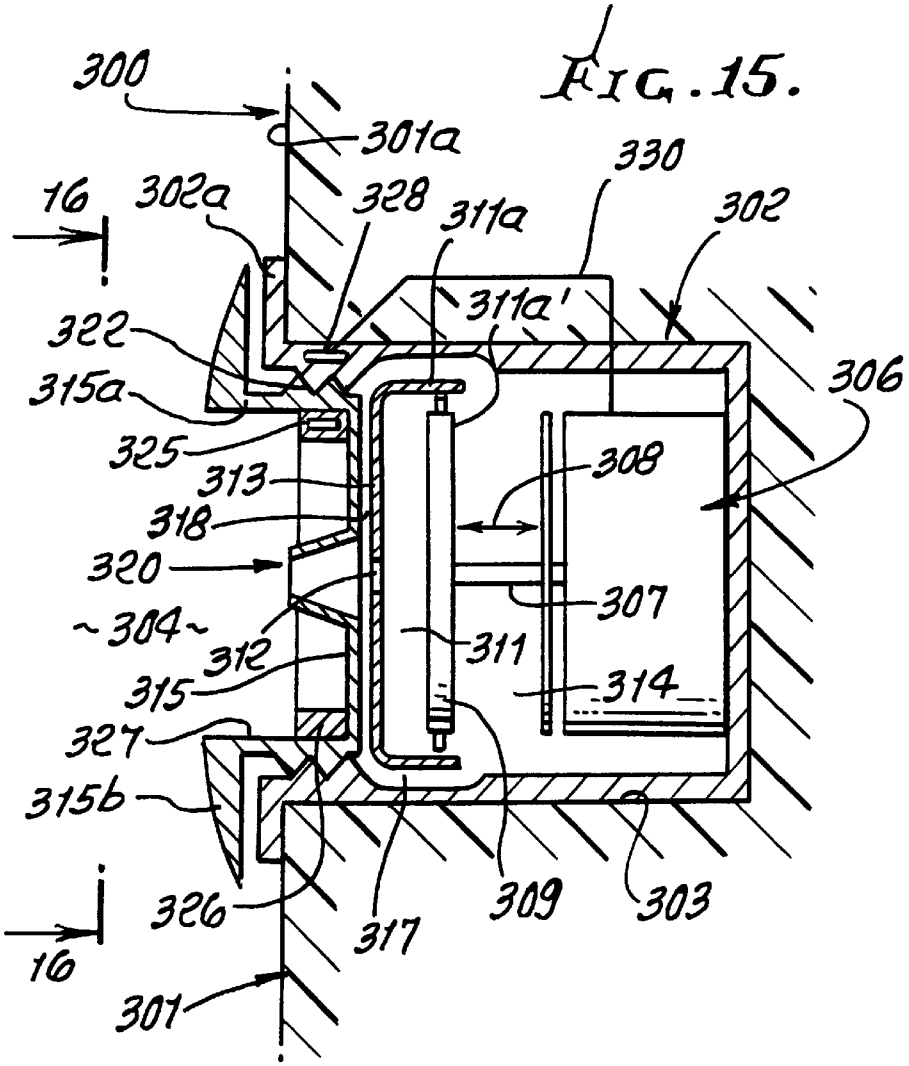
FIG. 15 is a vertical sectional view taken through an improved form of the apparatus incorporating a control at the water side of the tub wall.
Figure 16:
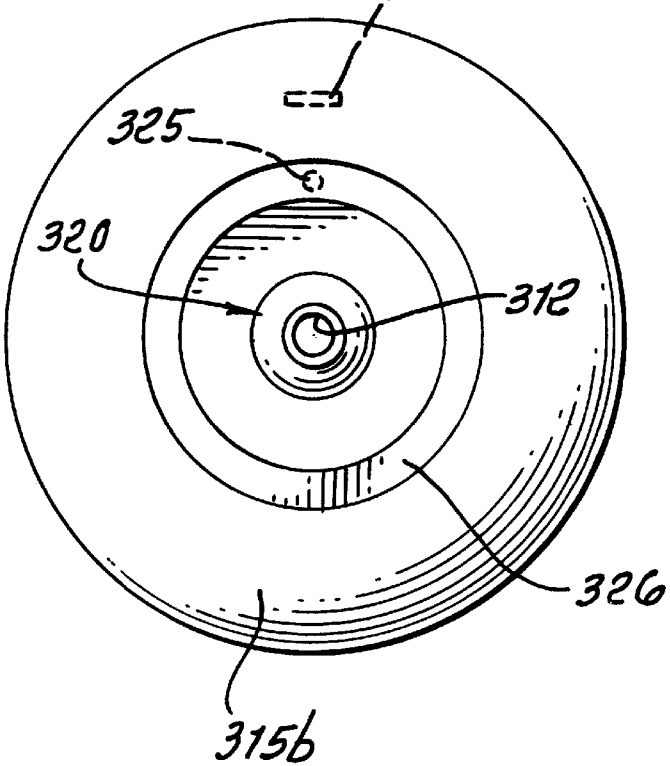
FIG. 16 is a front elevation taken on lines 16—16 of FIG. 15.

Referring now to FIGS. 15 and 16, the structure shown is somewhat similar to FIGS. 10 and 11. The upright wall of the spa or tub 300 is indicated at 301, and may consist of synthetic resinous material. A cup-shaped outer housing 302 may also consist of synthetic resinous material. It is set or received into a recess 303 formed in wall 301 opening toward the water-filled spa interior zone 304. Housing flange 302*a* fits against the wall inner side 301*a*.

Water delivery structure is received into the housing to deliver water into zone 304. Such structure, in the example, includes a driver 306, for reciprocating a plunger 307 in the directions indicated by arrows 308. A pumping piston 309 is coupled to the plunger and may comprise a circular plate.

The piston defines a water-displacing reciprocating element operable to move rightwardly in FIG. 15, to draw water into an inner chamber 311 at the front side of the plunger, as via a water flow inlet/outlet hole 312 in a chamber front wall 313. The periphery of the plate extends adjacent and reciprocates adjacent the fixed chamber skirt 311*a*. As the piston or plate 309 moves leftwardly, it displaces water from chamber 311 through the hole 312 toward and into the spa interior.

Water also flows to the rear side 311*a*' of the piston 309, as via an outer passage 317 extending outwardly of and about the inner chamber 311, i.e., it fills the space 314 between the driver 306 and the piston 309, serving to at least partly balance the water masses being moved by the piston as it reciprocates. This reduces vibration transmitted to the spa wall 301.

A front plate 315 extends forwardly of wall 313, to define a water flow passage 318 communicating between passage 317 and the inlet/outlet hole 312. Plate 315 carries a diffuser 320 having a forwardly tapering conical wall, and in axial alignment with hole 312. Plate 315 has a skirt 315*a* attached as via threading 322 to the housing 302, and a bezel 315*b* overlying flange 302*a*.

A permanent magnet 325 is carried by a rotatable ring 326 received into the front plate and skirt recess 327, and can be finger gripped by the bather in the tub or spa water to adjustably rotate the ring and magnet, and relative to a sensor 328. The sensor is shown as isolated from the water into the spa, by virtue of its spacing from the water-receiving zone or zones, as shown. For example, the sensor can be embedded in the housing 302, radially outwardly of the path of rotation of the magnet. As the magnet is rotated, its magnetic field projected outwardly toward the sensor is detected with varying strength as a function of magnet rotation. Accordingly, the output signal developed by the sensor has correspondingly varying amplitude, or other parameter.

A connection is shown at 330 from the sensor to the driver, and may, for example, vary the pushing output of the driver to vary the pumping effect of the piston, thereby varying the water jet output from the hole or jet opening 312 to the spa interior, as via the diffuser. A magnetic sensor, or a Hall Effect sensor, may, for example, be employed, as previously discussed.

Figure 21:
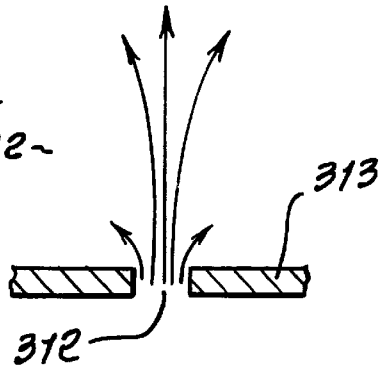
FIGS. 21–24 are schematic views showing jet flow relationships, in opposite directions, with respect to a hole or with respect to a diffuser and hole combination.
Figure 22:
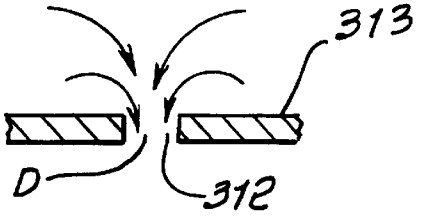
Figure 23:
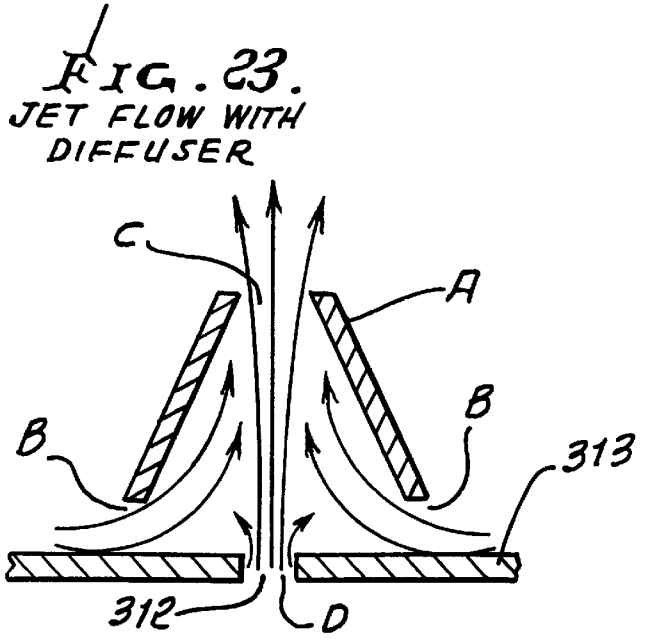
Figure 24:
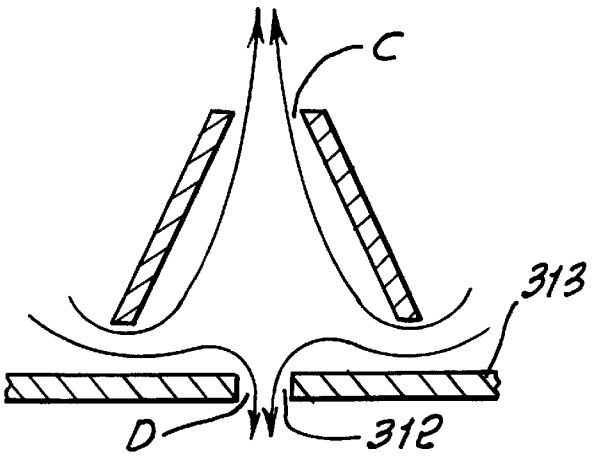

FIGS. 23 and 24 show the forward and rearward water flow characteristics when a diffuser is used; whereas, FIGS. 21 and 22 show such flow characteristics when a diffuser is not utilized.

Figure 17:
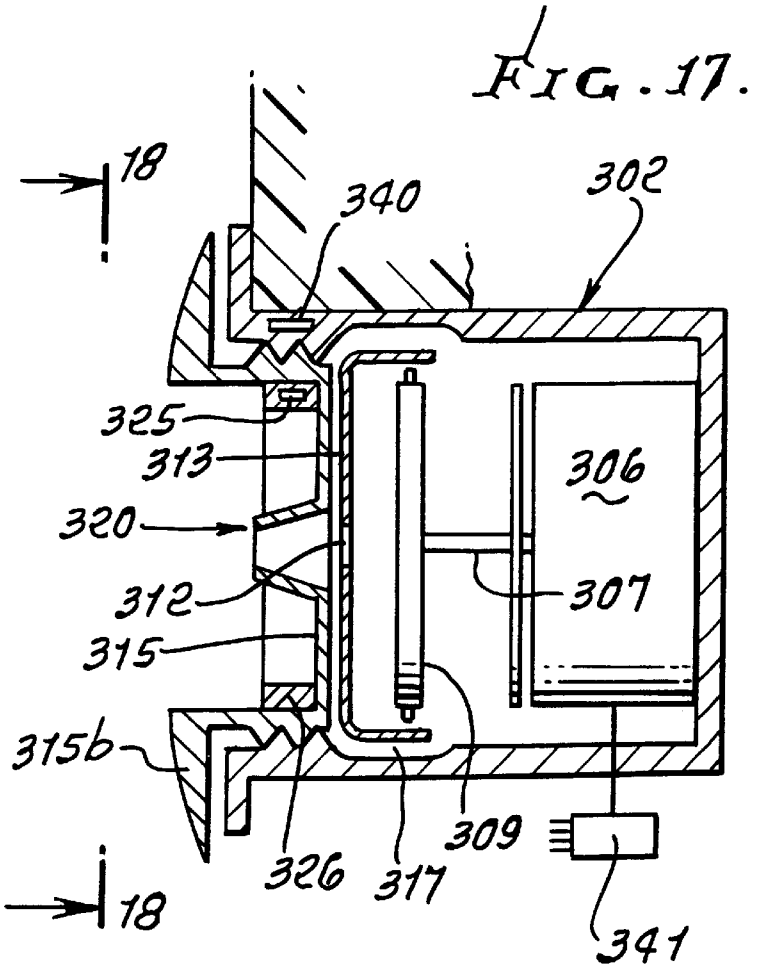
FIG. 17 is a view like FIG. 15 showing another form of the apparat incorporating a modified control.
Figure 18:
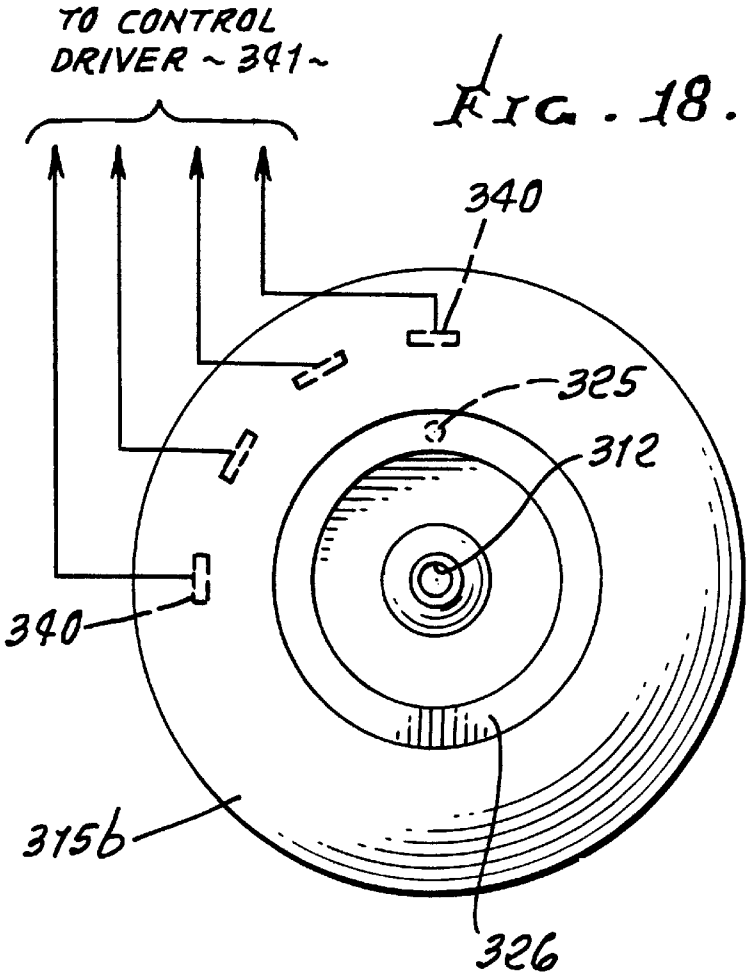
FIG. 18 is a front elevation taken on lines 18—18 of FIG. 17.

FIGS. 17 and 18 show the same structure as in FIGS. 15 and 16, except for the use of multiple sensors in the form of a series of reed switches 340, spaced apart circularly about the axis of the adjustable carrier ring 326. The magnetically sensitive reed switches are connected at 341 to the drive control, so that as rotation of the magnet 325 causes different ones of the switches to close, the output pulse rate of the drive can be stepwise varied. One or more such reed switches can be used.

FIG. 21 shows the tendency for the outward flow to maintain a confined "jet stream" perpendicular to the hole.

FIG. 22 shows the flow pattern of a liquid flowing into a hole D. The direction of the fluid flow is mainly hemispherical, not streamlike as in FIG. 21.

In FIG. 23, a diffuser A has been placed above the hole and in axial alignment with the hole. The jet stream, as it passes through the diffuser, entrains fluid, which flows in through openings B between the diffuser base and plate 313, and then flows through opening C. The net effect is to increase the overall volume of fluid in the jet stream, but also to reduce its velocity. This dampens the maximum pressure pulse, resulting in a softer feel of water impinging on the bather's skin.

In FIG. 24, fluid flow is shown passing reversely through 312, at the hole D. Fluid motion up through the diffuser persists, although diminished. The result is continuous flow through diffuser opening C, even during the inward flow period.

The result of placing the diffuser over a hole or nozzle with an alternating inward/outward flow is to soften the pulsating effect and give somewhat of a continuous flow pleasing to the bather.

Figure 20:
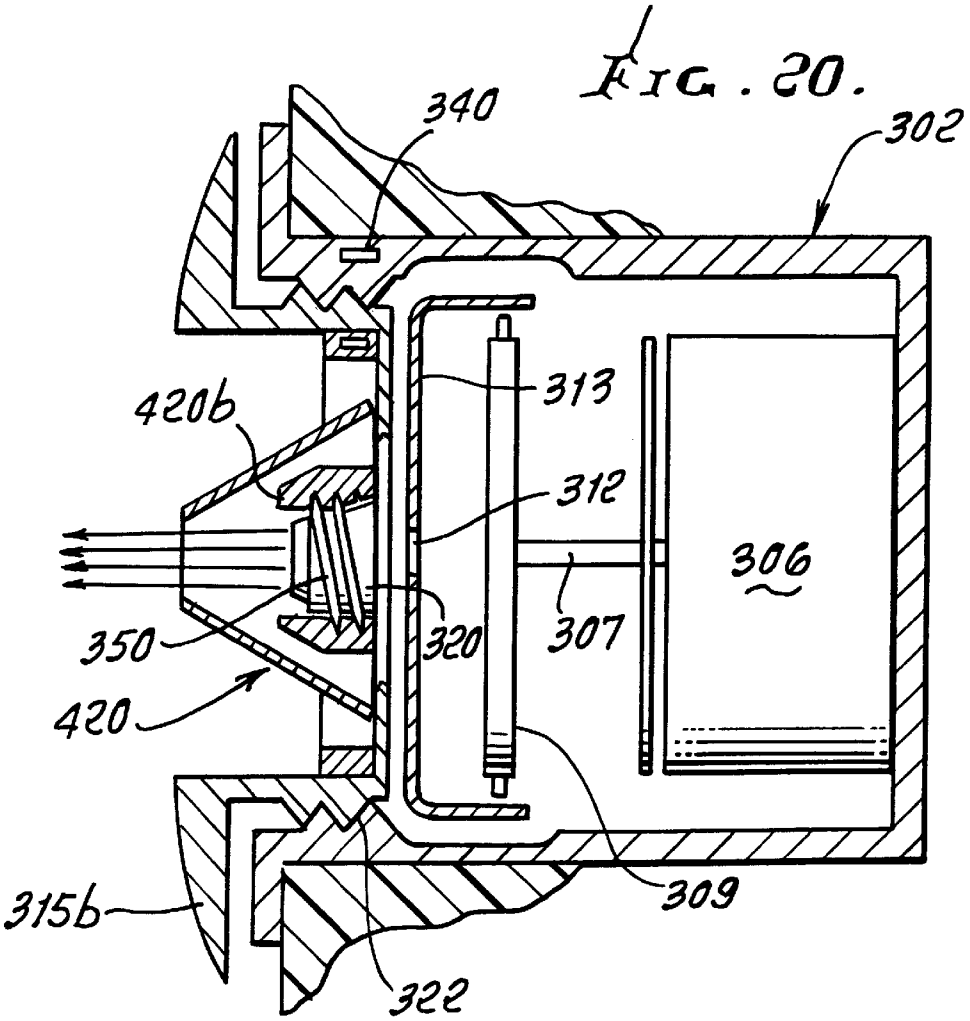
FIG. 20 is a view like FIG. 19 showing diffuser adjustment to closed position.
Figure 19:
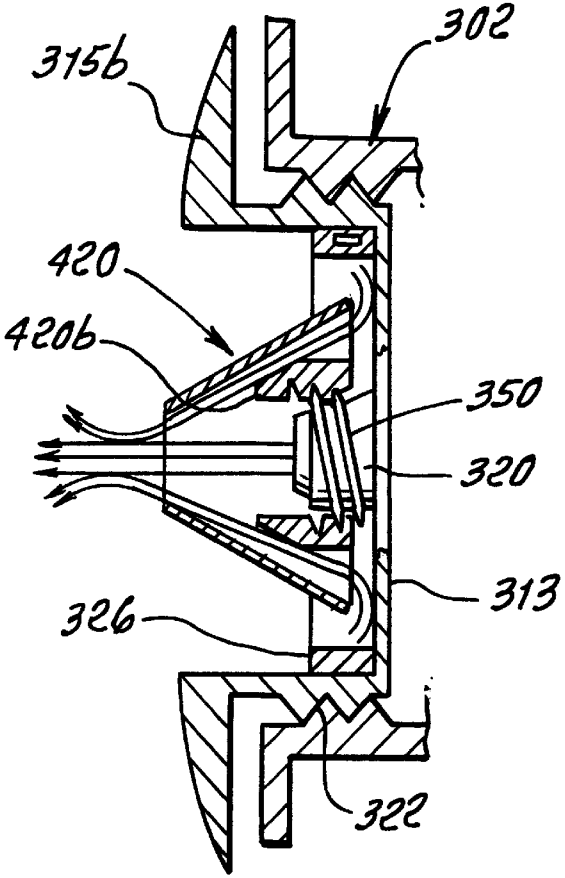
FIG. 19 is a view like FIG. 15 but showing provision of adjustable diffuser.

FIGS. 19 and 20 show an actual application of the diffuser to the nozzle of the structure shown. In this case, the diffuser 420 is made to be axially adjustable by threaded connection at 350 between diffuser annular inner portion 420*b* and the tapered tubular portion 320 of plate 313.

In the full open position seen in FIG. 19, water is entrained in through the diffuser as discussed above, in regard to FIG. 23. In FIG. 20, the diffuser is adjusted to the right to be in the closed position, so that there is no opening to allow water entrainment into the jet stream. In the closed position, it has no effect on the jet stream. By turning the diffuser, the bather is able to increase or decrease the size of the opening between the diffuser and the nozzle plate, which reduces to varying the variations in velocity and pressure amounts over a pulse cycle, and reduces the peak velocity and peak pressure.

The control devices of FIGS. 15–20 can be employed with any of the pumping devices shown in the various drawings.

The device of FIGS. 15 and 16, and equivalents, may be considered as preferred.

I claim:

1. In a spa water delivery system, the spa including a wall exposed to a water reception zone, the combination comprising:

a) water delivery structure including a pump adapted to be carried by said wall to deliver water to said zone, a housing receiving the pump and a water discharge port, the pump including a water displacing movable part having opposite sides to which water has access via said port, and including a passage about said part, b) a manually operable signaling device adapted to be carried by the wall to be operated by a bather in said water reception zone, c) a Hall Effect sensor spaced from said signaling device to be out of contact with spa water, and responsive to operation of said signaling device to produce a control signal, d) said pump controlled by said sensor produced control signal whereby said control signal is used to control a flow characteristic of water flowing via said delivery structure to said zone, e) said sensor located in the housing.

2. The combination of claim 1 wherein said signaling device provides a magnetic field, said sensor located in said field to be responsive to a changing characteristic of the field.

3. The combination of claim 1 including said wall which also carries said housing.

4. The combination of claim 3 wherein said signaling device provides a magnetic field, said sensor located in said field to be responsive to a changing characteristic of the field.

5. The combination of claim 4 wherein said device is a rotor extending about an axis defined by said port, said rotor being rotatable to vary the magnetic field sensed by said sensor.

6. The combination of claim 1 wherein said pump is oriented to receive water intake from said zone and to deliver water into said zone.

7. The combination of claim 1 wherein said pump includes a driver connected to said movable part, there being an electrical control having an input electrically connected to the output of said sensor, and an output electrically connected to said driver.

8. The combination of claim 1 including a diffuser in alignment with said water delivery structure, and adjustable to control a characteristic of said water flow.

9. The combination of claim 8 including means mounting the diffuser for adjustable movement toward and away from said port.

10. The combination of claim 9 wherein said means includes a thread connection between the diffuser and said housing.

11. For use in a water circulation device for a spa having a wall facing toward a water reception zone, the combination comprising a) a housing adapted for carriage by said wall, b) pumping structure associated with said housing, c) and control means for controlling pumping operation of said pumping structure, d) there being porting provided to create a simultaneous intake and discharge of fluid, so as to balance and cancel or reduce an associated momentum change, which in turn reduces forces imposed on said wall, e) there being an inner chamber within which a movable part of the pumping structure is reciprocable, and from which water is discharged relatively forwardly, said part having forward and rearward sides, f) and there being an outer passage extending outwardly of and about said inner chamber, and to which water is drawn via said porting, said outer passage communicating with the rear side of said inner chamber to deliver water to the rear side of said part, g) said porting, said inner chamber, and said outer passage being within said housing, h) said control means including an adjustable control element located at the water reception side of said wall.

12. In a spa water delivery system, the spa including a wall exposed to a water reception zone, the combination comprising:

a) water delivery structure including a pump adapted to be carried by said wall to deliver water to said zone, a housing receiving the pump and a displaced water passing port, the pump including a water displacing movable part having opposite sides to which water has access, via said port, b) a manually operable signaling device adapted to be carried by the wall to be operated by a bather in said water reception zone, c) a Hall Effect sensor spaced from said signaling device to be out of contact with spa water, and responsive to operation of said signaling device to produce a control signal, d) said pump controlled by said sensor produced control signal whereby said control signal is used to control a flow characteristic of water flowing via said delivery structure to said zone, e) said sensor carried by the housing.

* * * * *

UNITED STATES PATENT AND TRADEMARK OFFICE

CERTIFICATE OF CORRECTION

PATENT NO. : 5,983,416
DATED : November 16, 1999
INVENTOR(S) : Carsten H. Idland It is certified that error appears in the above-identified patent and that said Letters Patent is hereby corrected as shown below:

On the title page, [54] "ELECTRICALLY POWDERED SPA JET UNIT" should read --ELECTRICALLY POWERED SPA JET UNIT--

COLUMN 1, line 1, should read-ELECTRICALLY POWERED SPA JET--.

Signed and Sealed this

Sixteenth Day of May, 2000

*Attest:*

*Attesting Officer*

Q. TODD DICKINSON

*Director of Patents and Trademarks*